United States Patent [19]

Matsufuji et al.

[11] Patent Number: 4,477,823

[45] Date of Patent: Oct. 16, 1984

[54] INK JET RECORDING APPARATUS

[75] Inventors: Yohji Matsufuji; Shigeo Togano; Hiroo Ichihashi, all of Tokyo, Japan

[73] Assignee: Canon Kabushiki Kaisha, Tokyo, Japan

[21] Appl. No.: 330,017

[22] Filed: Dec. 11, 1981

[30] Foreign Application Priority Data

| | | | |
|---|---|---|---|
| Dec. 27, 1980 | [JP] | Japan | 55-188867 |
| Dec. 27, 1980 | [JP] | Japan | 55-188868 |
| Dec. 27, 1980 | [JP] | Japan | 55-188869 |
| Dec. 27, 1980 | [JP] | Japan | 55-188870 |
| Dec. 27, 1980 | [JP] | Japan | 55-188871 |

[51] Int. Cl.[3] ..... G01D 15/18

[52] U.S. Cl. ..... 346/140 R; 346/75

[58] Field of Search ..... 346/75, 140 IJ, 140 PD

[56] References Cited

U.S. PATENT DOCUMENTS

| | | | |
|---|---|---|---|
| 3,211,088 | 10/1965 | Naiman | 101/114 |
| 3,967,286 | 6/1976 | Andersson et al. | 346/140 PD |
| 4,187,511 | 2/1980 | Robinson | 346/140 IJ X |
| 4,385,304 | 5/1983 | Sniderman | 346/140 PD |

*Primary Examiner*—George H. Miller, Jr.

*Attorney, Agent, or Firm*—Fitzpatrick, Cella, Harper & Scinto

[57] ABSTRACT

Ink jet recording apparatus having a full line multi-array orifice type ink jet head to perform the recording operation at its predetermined position, an ink storing tank to store ink for feeding to the ink jet head, and a common supporting member, on which the ink jet head and the ink storing tank are communicatively connected to each other in a manner not to cause relative positional displacement between them.

9 Claims, 8 Drawing Figures

INK JET RECORDING APPARATUS

BACKGROUND OF THE INVENTION

1. Field of the Invention

This invention relates to an ink jet recording apparatus, and, more particularly, it is concerned with a recording apparatus provided with an ink jet head which is generally called "full line multi-array orifice type head".

2. Description of the Prior Art

Of various recording systems which are known at present, the so-called "ink jet recording system" is regarded as highly useful in realizing various types of recording apparatus, such as printer, word processor, reproduction device, etc., because it belongs to a non-impact recording system which produces the least noise at the time of recording, and is capable of recording at a high speed and on a plain paper without necessity for any special fixing treatment. So far, various proposals have been made for this ink jet recording system, some are already commercialized after many improvements, and others are still under way towards practical use.

The ink jet recording system is to perform image recording by causing droplets of recording liquid (throughout the description in this specification, the liquid is called "ink") to fly, on various operating principles, onto the surface of a recording material such as paper, etc. An ink droplet producing device for use in such an ink jet recording system, i.e., an ink jet device, consists generally of an ink jet head to form the ink droplets and an ink feeding system to feed ink to the head.

As a type of the ink jet head, there is one that is generally called "a single orifice type" or "a semi-multi-orifice type" head having one to ten, or so, of the ink discharging orifices. This type of head is relatively simple in its construction, is easy to replace when the head is out of order or damaged, and is not so expensive as the other recording systems. In addition, since the ink feeding system for this type of ink jet head has a lesser number of ink discharge orifices, there is less consumption of ink. Thus, it can be constructed relatively simply by utilizing a simple cartridge tank or a single ink feeding pipe.

However, when using a different type of the ink jet head, generally called "full line multi-array orifice type head", capable of printing a line on paper almost instantaneously, the replacement work of the head is not easy thereby increasing possibility of trouble and damage occurring in some part of the head. Further, from the economic aspect, the replacement of the entire head is limited. Furthermore, when using the full line multi-array orifice type head, it is necessary to maintain constant a space interval between the head and the surface of the recording paper throughout its breadth during the recording operation. In order to attain this objective, there have so far been required high mechanical precision and assembly precision as well as complicated accessory mechanisms and troublesome measures for preventing ink contamination of the head and for protecting the head itself during stoppage of the recording apparatus.

In addition, the ink feeding system for this type of the ink jet head necessitates a large number of ink feeding pipes and an ink tank of a large capacity for uniform ink feeding to the entire head, because the ink discharging orifices should be provided in an extremely large number in this type of the ink jet head, which causes the ink consumption through the entire head to be much higher than in the aforementioned case. As the consequence of this, the overall construction of the device becomes inconveniently complex and large in size.

SUMMARY OF THE INVENTION

It is therefore an object of the present invention to provide an ink jet recording apparatus, from which all the disadvantages inherent in the conventional device have been removed.

It is another object of the present invention to provide the so-called "full line multi-array orifice type" ink jet recording apparatus capable of forming, at the ink discharge orifices, ink droplets faithful to input signals and of performing substantially perfect and favorable recording as the result of such droplet formation.

DETAILED DESCRIPTION OF THE PREFERRED EMBODIMENTS

In the following, the present invention will be explained in detail with reference to preferred embodiments thereof as shown in the accompanying drawing.

Figure 1:
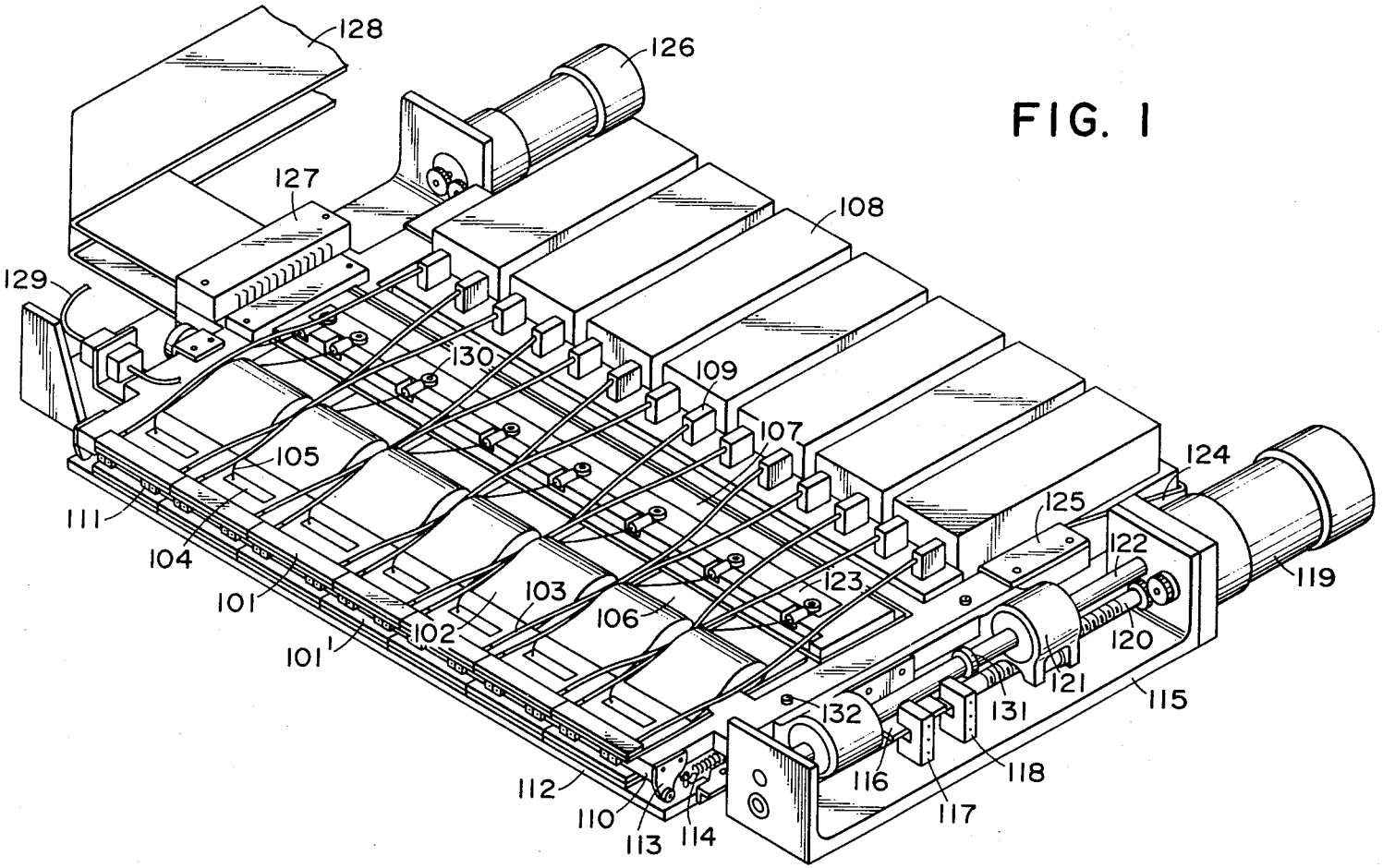
FIG. 1 is a perspective view showing the outer appearance of the ink jet recording apparatus according to the present invention.

Referring first to FIG. 1 showing a perspective view of the ink jet recording apparatus according to the present invention, reference numerals 101, 101' designate upper and lower ink jet heads, respectively, of the multi-array orifice type, in the lateral end face of which a multitude of ink discharge orifices are disposed rectilinearly (on one line, for example). A numeral 102 refers to a flexible printed plate to electrically connect the heads 101, 101' and a semiconductor installing base plate 106. A numeral 103 refers to a conduit pipe to feed ink to the heads 101, 101' from an ink tank 108 through a connector 109. A reference numeral 104 designates a common pad to collect a plurality of lead wires which transmit electrical signals to the heads 101, 101'. The pad 104 is further connected to a signal output section (not shown) provided in the main body, where the ink jet recording apparatus, as illustrated, is mounted, through a lead wire 105, a lead terminal 130, a lead terminal fitting plate 123, and a drive circuit connecting line 129. The other lead wires necessary for driving the heads 101, 101' are connected to the printed plate 102, after which they are wired in matrix form on a multi-layered wiring base plate 107 through the semiconductor installing base plate 106, and further connected to the signal output section (not shown) through a connector 127 and another drive circuit connecting line 128. A numeral 110 refers to a common base plate to mount thereon the ink jet heads 101, 101', the semiconductor installing base plate 106, the multi-layered wiring base plate 107, and other elements associated with the heads. The common base plate 110 fixedly secures on both surfaces thereof the upper and lower heads 101, 101' with a plurality of fixing pawls arranged on one lateral side thereof. This common base plate 110 is also connected with an ink tank holding plate 124 at a connecting section 125. A reference numeral 112 designates a cap common to all of the ink jet heads 101, 101', and a numeral 113 refers to a contact pressure adjusting plate between the cap 112 and the heads 101, 101'. A numeral 114 refers to a spring. A numeral 115 denotes a fixing block to set the ink jet recording apparatus on the main body (not shown). A motor 119 functions as the power source for a driving screw rod 120 and a housing 121, which causes the head mounting base plate 110 connected to the housing 121 to reciprocate in the axial direction of the driving screw rod 120 as it rotates. A stopping position of the reciprocating base plate 110 is determined by detecting a position of a reference leaf 116 moving with the housing 121 through a backward stoppage sensor 117 and a forward stoppage sensor 118. Incidentally, a numeral 122 refers to a guide rail for the reciprocating movement of the housing 121 as mentioned above, and 131 a stopper for the housing. Further, the head mounting base plate 110 and the fixing block 115 are joined together with screws 132. Furthermore, another motor 126, though not indispensable for the present invention, functions as a power source for oscillating the cap 112 contacted with the heads 101, 101', depending on necessity. Although FIG. 1 illustrates an embodiment, wherein a plurality of pre-divided ink jet heads 101, 101' are juxtaposed on both surfaces of the base plate 110, it is also feasible to use a single, elongated head having a group of full line multi-array orifices to extend over the span of the recording medium.

Figure 2:
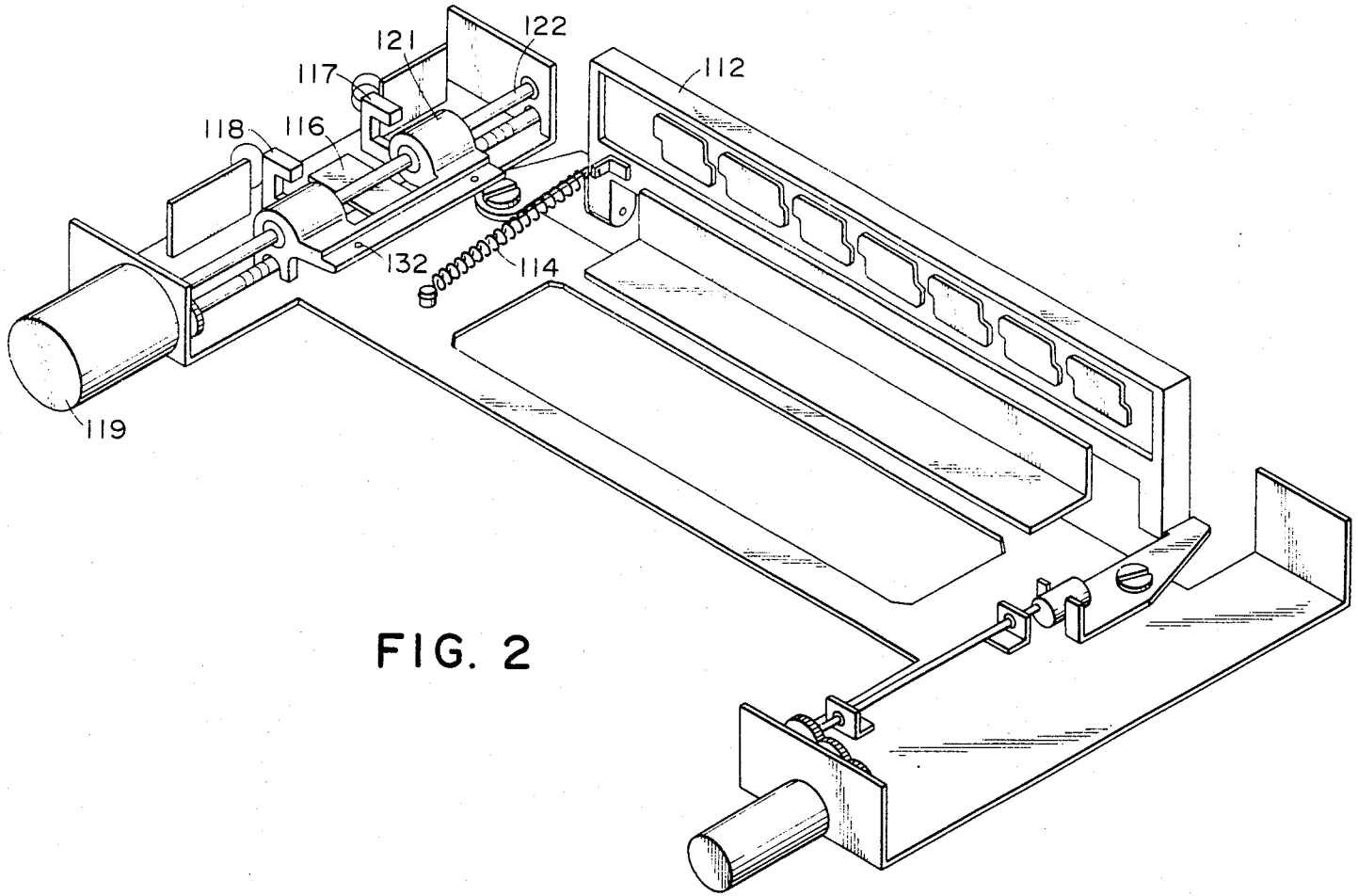
FIGS. 2, 3A and 3B are perspective views for explaining further details of the main part of the apparatus shown in FIG. 1.

FIG. 2 shows a perspective view of the fixing block 115, in the main, as seen from the side of the ink tank 108 after removal of the heads and the ink tank in FIG. 1. In FIG. 2, the same parts in FIG. 1 are designated by the same reference numerals, and the explanations for them are dispensed with.

Figure 3A:
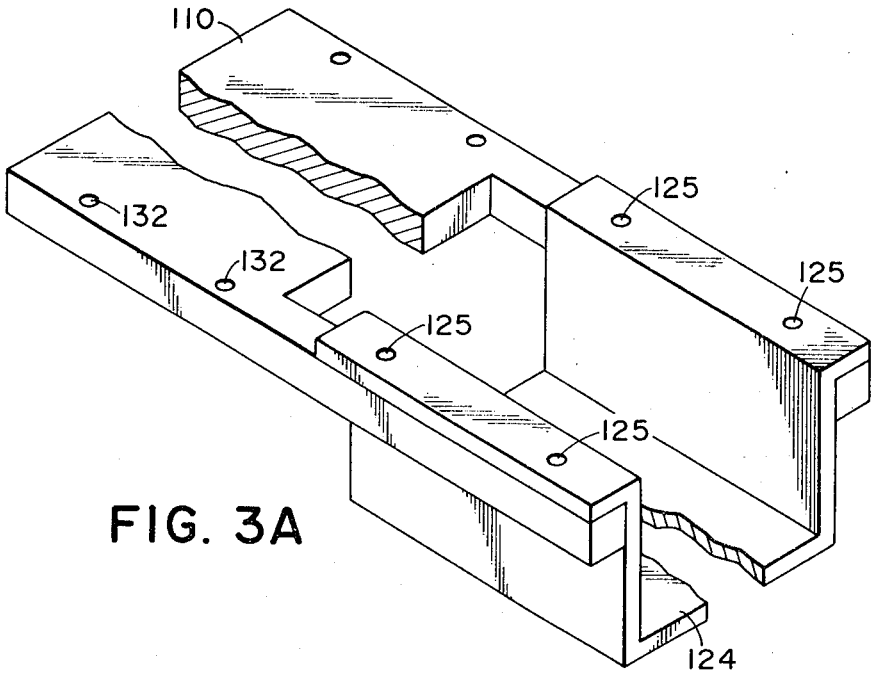
Figure 3B:
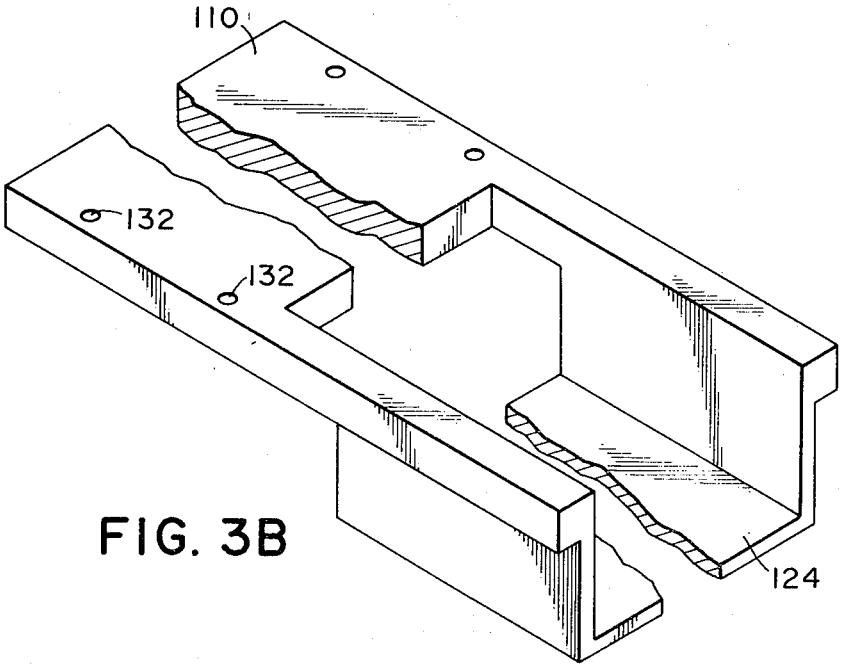

FIGS. 3A and 3B illustrate, respectively, examples of a unit consisting of the head mounting base plate 110 and the ink tank holding plate 124 according to the present invention. FIG. 3A shows an embodiment, wherein the head mounting base plate 110 and the ink tank holding plate 124 are separately constructed to be joined together, in assemblage, with screws, etc., at the connecting section 125. This unit of the base plate 110 and the holding plate 124 is screw-connected with the fixing block 115 shown in FIG. 2 at its connecting section 132. After the unit is fitted onto the fixing block, the ink jet heads 101, 101' are mounted on the base plate 110, and the ink tanks 108 on the holding plate 124, at their predetermined positions and in a freely mountable and dismountable manner. Incidentally, the base plate 110 and the holding plate 124 may be made, for example, of a metal material such as aluminum, stainless steel, etc., or an organic plastic material such as polyacetal resin, acryl resin, and others. FIG. 3B illustrates another embodiment, in which the base plate 110 and the holding plate 124 are integrally formed. Such an integral unit can be readily formed by for example, aluminum die-casting technique, and is advantageous in that the joining step of the base plate and the holding plate can be dispensed with.

Figure 4:
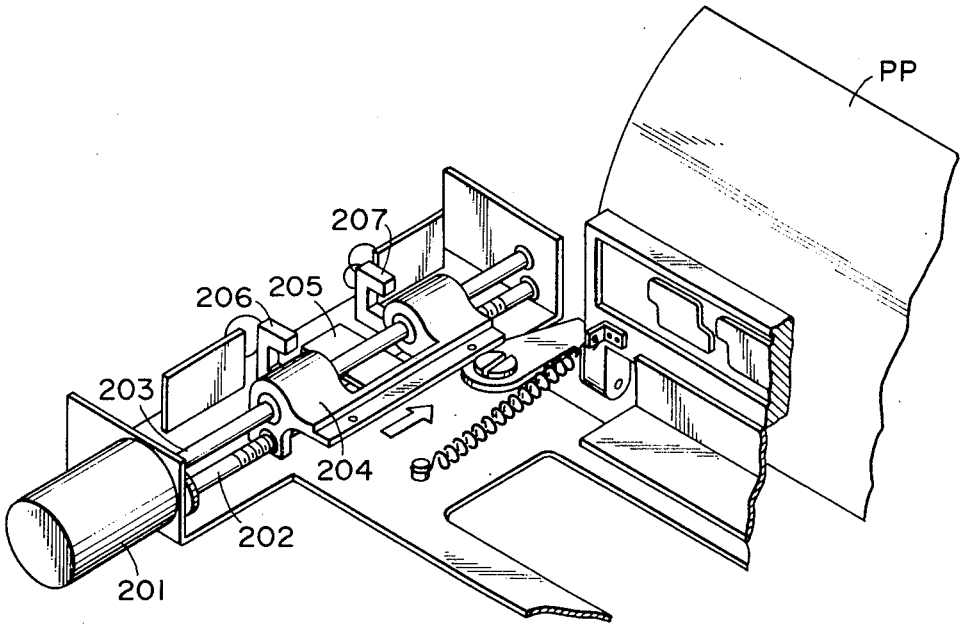
FIGS. 4, 5, 6A and 6B show, in various views, another embodiment of the present invention.
Figure 5:
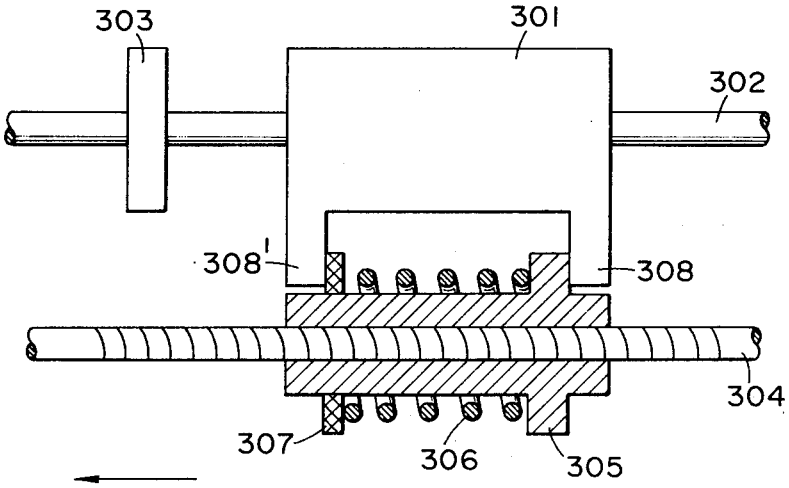

FIG. 4 is a perspective view, in part, showing, as another embodiment of the present invention, the details of the driving system mounted on the fixing block 115 after removing the head mounting base plate 110. FIG. 5 is a front view, partly in longitudinal cross-section, of the main part of the housing 121 shown in FIG. 1 to be connected with the head mounting base plate and to cause the same to move.

Referring now to FIGS. 4 and 5, the movements (both forward and backward) of the housing will be explained in further detail. In a state of the non-recording operation, when a switch (not shown) is turned on, the head mounting base plate (not shown) arranged at its predetermined position relative to the surface of the recording paper (not shown) advances towards the surface of the recording paper PP due to advance-movement on and along the guide rail 203 of the housing 204, to which the head mounting base plate is connected, and which is subject to driving force from the motor 201 and the driving screw rod 202. The housing 204 is advanced by the driving screw rod 202 rotating by rotational force from the motor 201 through gears (not shown). In practice, however, it is pushed for movement by a nut 305 moving on and along a driving screw rod 304 as shown in FIG. 5. A housing 301 has a recess in its lower part with projections 308, 308' on both end parts thereof, the abovementioned nut 305 and a spring 306 as well as a washer 307 being accommodated in the recess. The spring 306 is compressed to a certain extent so as to urge the projection 308' through the washer 307.

In the case of the recording system utilizing the full line multi-array orifice type ink jet head, the space gap between the surface of the recording paper and the distal end of the ink jet head should be defined very precisely, as mentioned in the foregoing. For this purpose, the ink jet head as advanced must stop accurately at a predetermined position against force of inertia.

The stoppage of the housing 204 coupled with the head mounting base plate (not shown) is performed by the forward stoppage sensor 206. When the reference leaf 205 passes by the sensor 206, a stoppage signal is emitted and the motor 201 stops its motion. However, since the motor does not stop its rotation instantaneously due to inertia, the housing 204 and the head mounting base plate (not shown) coupled therewith would actually stop at an irregular position before the predetermined one (i.e., a position closer to the surface of the recording paper PP), where the intended object cannot be attained. In order to solve this problem, the present invention provides a stopper 303 against the forward movement of the housing 301, as shown in FIG. 5, in such a manner that a timing for the stop sensor 206 in FIG. 4 to actuate may correspond to a timing for the housing 301 in FIG. 5 to be in contact with the stopper 303. Further, excessive rotation of the motor 201 can be absorbed by compression of the spring 306 in FIG. 5. The backward movement of the housing 204 (in the direction opposite to the arrow mark in the illustration) can be done in the same manner as in the forward movement by reversing the motor rotation. As it is considered that a slight difference in the stopping position becomes least problematical, provision of the backward stopping sensor 207 alone will suffice. If it is, however, necessary to do so, the backward stopping position can be regulated by the stopper.

Figure 6A:
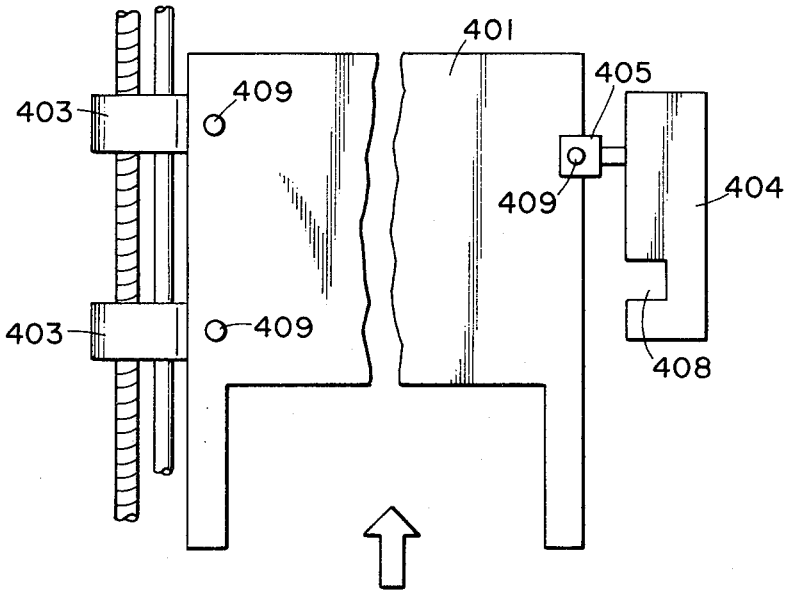
Figure 6B:
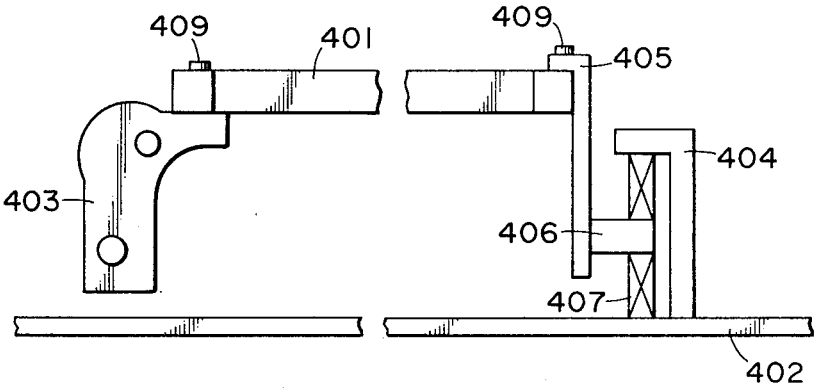

FIGS. 6A and 6B illustrate a state, wherein the head mounting base plate is joined with the housing. In the drawing, FIG. 6A is a plan view, and FIG. 6B is a side view of FIG. 6A when it is seen from the arrowed direction. (It should be noted that the group of head units are all omitted from the base plate for the sake of convenience in explanation.) A reference numeral 401 designates the head mounting base plate, and 403 refers to the housing same as mentioned above. A bearing 407 is provided for maintaining the group of head units (not shown) fixed on the base plate 401 in parallel with the fixing block 402, and for smoothly moving the base plate 401 in parallel with the surface of the fixing block 402.

A numeral 404 refers to a cover for the bearing 407, 405 a connecting plate, 406 a supporting shaft for the bearing, and 409 tightening screws. The cover 404 is for preventing the group of head units from being fanned, when they are subjected to vibrations and jamming, hence the head units should be longer in the longitudinal direction thereof than the moving distance of the housing 403. A notched portion 408 is of a size that permits passage of the bearing 407 therethrough, so that mounting and dismounting of the head mounting base plate onto and from the housing 403 can be done at this position.

The ink jet recording apparatus according to the present invention, which has so far been detailed in the foregoing, has a plurality of separately constructed ink jet heads, and the drive circuit and ink feeding system associated with the heads, which are integrally united on the common supporting member. On account of this, it can be readily equipped on the main body of the apparatus employing such recording device at its output section. Further, as there occurs no relative positional displacement between the ink jet heads and the ink feeding system during the recording operation, no irregularity takes place in the ink feeding pressure and the ink can be uniformly fed to all of the ink jet heads, whereby stable ink jet recording operation can be achieved.

Furthermore, as has already been explained in reference to FIGS. 4, 6A and 6B, the present invention makes it possible to automatically and precisely position the group of full line multi-array orifice type ink jet heads and accessories such as ink feeding device, etc., relative to the surface of the recording paper, while maintaining good integrity among these component elements. Moreover, during stoppage, all of ink jet heads can be sufficiently set apart from the surface of the recording paper, so that it can be well protected from unexpected stain due to ink splash and the ink jet head per se can be kept off the recording paper, and so on.

In addition, since the present invention constructs the ink jet heads and the ink feeding system in a unit, replacement and repair of the component parts are facilitated. Further advantages in maintenance of the apparatus can be attributed to this unit construction.

What we claim is:

1. Ink jet recording apparatus of the full line type which comprises: a plurality of ink jet head units each comprising:

a multi-array orifice ink jet head for effecting recording at a predetermined position;

semiconductor means for driving said ink jet head to project a liquid droplet on demand from each orifice; and multi-layered wiring means for supplying electric signals to said semiconductor means;

a plurality of reservoirs for storing ink to be fed to said ink jet heads, each said reservoir being for feeding ink to a respective one of said ink jet head units; and a common supporting member for supporting said ink jet head units and said reservoirs, said ink jet head units and reservoirs each being disposed on said common supporting member so that the relative position between them is maintained during operation of said apparatus.

2. An ink jet recording apparatus as set forth in claim 1, wherein said ink jet head has a plurality of ink discharge orifices arranged in a predetermined form.

3. An ink Jet recording apparatus as set forth in claim 1, wherein each said ink jet head unit and the respective said ink reservoir are communicatively connected by a conduit tube.

4. An ink jet recording apparatus as set forth in claim 1, wherein said common supporting member is disposed on a base table to support the same in a manner to be movable in parallel with said base table.

5. Ink jet recording apparatus as set forth in claim 1, further comprising a driving system for moving said supporting member along a predetermined pathway.

6. An ink jet recording apparatus as set forth in claim 5, further comprising a drive control system, associated with said driving system, for controlling movement of said supporting member.

7. An ink jet recording apparatus as set forth in claim 5, wherein said driving system is provided with positioning means for regulating a stopping position of said supporting member.

8. An ink jet recording apparatus as set forth in claim 5, wherein said supporting member and said driving system are mutually connected at one part thereof.

9. An ink jet recording apparatus as set forth in claim 5, wherein said ink jet head has a plurality of ink discharge orifices arranged in a predetermined form.

* * * * *